US005188367A

United States Patent [19]

Gipe et al.

[11] Patent Number: 5,188,367

[45] Date of Patent: Feb. 23, 1993

[54] GOLF TRAINING-EXERCISE APPARATUS

[75] Inventors: Thomas A. Gipe, Beltsville, Md.; Steve R. Yoder, Gordonville, Pa.

[73] Assignee: Pear Tree Mfg., A Corporation of Pennsylvania, Gordonville, Pa.

[21] Appl. No.: 872,943

[22] Filed: Apr. 21, 1992

Related U.S. Application Data

[63] Continuation-in-part of Ser. No. 728,481, Jul. 11, 1991, abandoned.

[51] Int. Cl.[5] ..... A63B 69/36

[52] U.S. Cl. ..... 273/191 R; 273/191 A; 273/186.2

[58] Field of Search ..... 273/35 R, 191 R, 191 A, 273/191 B, 186.1, 186.2

[56] References Cited

U.S. PATENT DOCUMENTS

| | | | |
|---|---|---|---|
| 2,448,904 | 9/1948 | Millner | 273/191 R |
| 2,813,721 | 11/1957 | Zega | 273/191 A |
| 3,429,571 | 2/1969 | Abel, Jr. | 273/186.1 |
| 3,876,212 | 4/1975 | Oppenheimer | 273/191 R |
| 4,326,718 | 4/1982 | Kiehl | 273/186.1 |
| 4,449,708 | 5/1984 | Humphrey | 273/191 B |

*Primary Examiner*—V. Millin
*Assistant Examiner*—Steven B. Wong
*Attorney, Agent, or Firm*—Sughrue, Mion, Zinn, Macpeak & Seas

[57] ABSTRACT

A generally rigid golf club suspension rod rotatably suspends a golf club head by a universal connector. Rotation of the rigid rod is transmitted through a knuckle to a circular gear mounted for rotation about a substantially horizontal axis. The circular gear is supported on a carriage for movement longitudinally of a horizontally disposed housing and the circular gear is in mesh with a longitudinally extending fixed rack such that swinging of the golf club and rotation of the suspension rod drives the carriage to the left or right in the direction of the swing path of the golf club depending upon whether the player is in the back swing or the fore swing. The universal connector gives a normal feel to the player handling the golf club, and the longitudinal movement of the carriage provides realistic elliptical swing paths for the golf club head in the backward and forward swings of the golf club. The result is to permit a full shoulder turn allowing the club to attain a position parallel to the flight path at the conclusion of the back swing. The transition of the swing plane results in a proper "inside-out" down swing and follow through of the golf club. A tripod adjustably supports a vertical upright support tube which in turn supports a gear head assembly which includes the carriage, the circular gear and the knuckle.

24 Claims, 6 Drawing Sheets

103
130
103a
104b
108a
108
104
150
151
26b
120
121
103
130
103a
108
104b
13
12
27
22
11
40
10
5
4
3b
51
160
36
134
106a
143
24
19a
142
140
25c
104
107
25a
26a
102
104a
101
130
102a

GOLF TRAINING-EXERCISE APPARATUS

RELATED APPLICATION

This application is a continuation-in-part of application Ser. No. 07/728,481 filed Jul. 11, 1991 now abandoned.

FIELD OF THE INVENTION

The present invention relates to an apparatus for controlling the swing of a golf club in the manner of expert players. Thus, a person using the apparatus will learn to swing a golf club in the same manner as an expert.

DESCRIPTION OF THE BACKGROUND ART

The ability of a player to hit a golf ball properly is largely dependent upon the path of the golf club during the swing. Although the styles of expert players may vary widely, the basic motion of their golf clubs during their swing is strikingly similar. The concept of prior art devices is to control the motion of the golf club to emulate that of an expert player.

A novice by repeatedly practicing his swing on a trainer learns the "feel" of a proper golf swing. The effectiveness of these training devices is dependent on their ability to simulate actual playing conditions. The more life-like the practice swing, the more likely the player can duplicate the swing while using a golf club under real playing conditions.

The prior art training devices use a number of different means for controlling the golf club. There are two basic types of devices. The control is maintained by connecting the device to the golf club by either 1) the head of the golf club or 2) the shaft of the golf club. The key to the feel of the swing is the mechanism that controls the rotation of the golf club.

A key deficiency of all of the prior art is the limit placed on the variation of the plane of the swing. The prior art devices such as U.S. Pat. No. 2,448,904 to S.A. Millner, force the player to use the same swing plane for both the back and forward swings. The use of a single plane incorrectly emulates the actual golf swing, which in contrast uses different swing planes for the back and forward swings and also both swings are elliptical rather than circular.

SUMMARY OF THE INVENTION

The present invention is an apparatus for teaching and practicing the proper form, motion and rhythm of the complete golf swing from back swing to follow through.

A golf club is connected to a rod or shaft extending from a gear head assembly which is supported by a main support tube. The gear head assembly allows the rod two types of movement: 1) A rotational movement with the connection between the end of the shaft and the gear head assembly acting as the center point of the rotation where the plane of rotation may change, and 2) A horizontal linear movement along the track of the gear head assembly.

The dual motions allows the apparatus to properly control the club swing of the player and automatically ensure elliptical swings without improperly restricting the movement of the player's body. Thus, the player can exercise a fluid and natural feeling elliptical swing. Further, the ability to change the plane of the rotational movement allows the player to vary the swing plane between the back and forward swings required for a proper golf swing. The ability to change the swing plane overcomes the deficiency in the prior art devices discussed above.

Another object of the invention is to allow players of different height and build to use the apparatus with only minor adjustments to the apparatus that can be made quickly and efficiently in a matter of minutes. This object is accomplished through three adjustable features. First, the gear head assembly can be raised or lowered by sliding its mount arm up and down the main support tube, respectively. Second, the shaft connected to the golf club consists of a telescopic tube assembly which is lengthened or shortened according to the height of the gear head assembly and the distance of the player from the gear head assembly. Third, optionally, an adjustable tee bar or a tee "mat" allows the player to stand further from the main support tube and still hit a golf ball from the tee.

A further object of the invention is to allow the use of the apparatus either indoor or outdoor and either fixedly mounted or free-standing. This is accomplished through various different mounting devices and the use of composites, plastics, metal alloys and the like for all components of the apparatus.

The final object of the invention is to allow the player to use the apparatus to hit either a real or practice golf ball. Thus the player can not only feel the proper swing but can see the actual flight of the golf ball after impact with the golf club when the apparatus is used outdoors.

In summary, the present invention provides an improved apparatus for learning or practicing a complete golf swing with the proper form, motion and rhythm, such that the apparatus provides the player with the feel of real playing conditions.

DETAILED DESCRIPTION OF THE INVENTION

Figure 1:
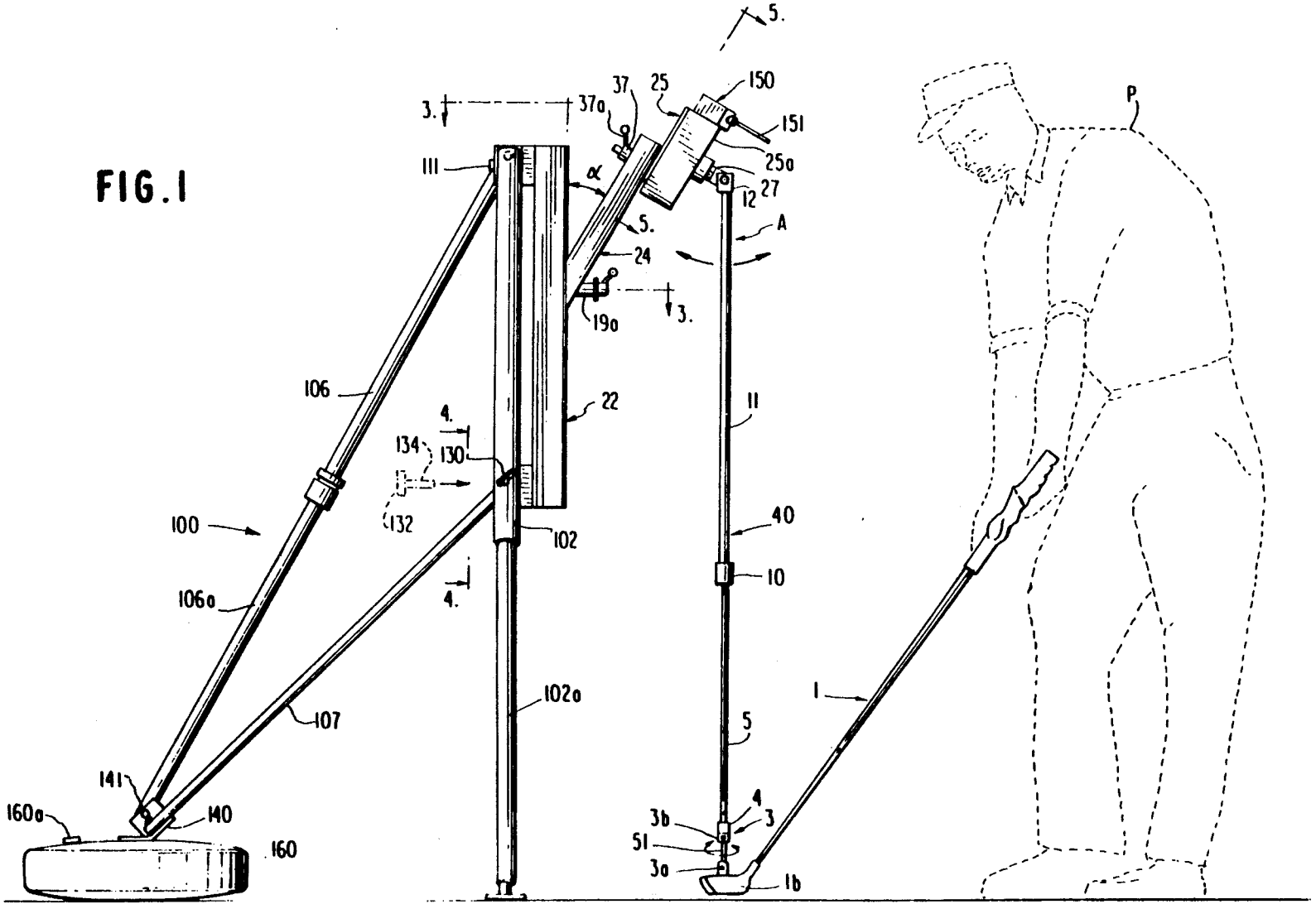
FIG. 1 is a side elevational view of a golf training exercise apparatus forming a preferred embodiment of the invention.

The invention as shown in FIG. 1 includes a golf club 1, adapted to be swung by the player P using the apparatus indicated generally at A, which is attached to a lower tube 5 of a telescoping tube assembly 40 by a three axis movement, custom universal joint 3. Lower tube 5 is telescopically connected to an upper tube 11 so that lower tube 5 may be unlocked from upper tube 11, moved relative to upper tube 11 and relocked, so that the combined length of upper and lower tubes 11, 5 is either increased or decreased. Combined, upper and lower tubes 11, 5 form a generally rigid club head suspension rod or telescopic tube assembly 40 and tubes 5, 11 are made of lightweight, strong materials such as a graphite composite, aircraft aluminum or the like. Preferably upper tube 11 is made of aluminum, and lower tube 5 is made of a graphite composite. End bushing 10 is coupled to upper tube 11 to assure a smooth fit of lower tube 5 which telescopes at bushing 10 inside upper tube 11.

Upper tube 11 is connected to gear head assembly 25 by a yoke 12. Gear head assembly 25 is slidably mounted in a vertical plane on the main support tube or vertical support member 22 through gear head assembly arm mount 24 which is disposed at an angle $\alpha$ to main support tube 22.

Angle $\alpha$ between main support tube 22 and the gear head assembly arm mount provides two benefits. First, it extends gear head assembly 25 and golf club 1 away from main support tube 22 to prevent interference by main support tube 22 with the player's swing.

Second, angle $\alpha$ results in face 25*a* of gear head assembly 25 being set at an angle relative to the vertical axis of main support tube 22. The angle of gear head assembly 25 serves to prevent upper tube 1 from binding at driver knuckle 27 as shown in FIG. 1 when upper tube 11 is swung by the movement of golf club 1. If an obtuse angle is not maintained between upper tube 11 and driver knuckle 27 when the tube 11 is parallel to the main support tube 22, driver knuckle 27 will be prevented from rotating, thereby stopping the lateral movement of driver knuckle 27 along gear head assembly 25. The preferred angle o between main support tube 22 and gear head arm mount 24 is within an approximate range of 22°-38°. The obtuse angle between the axis of rotation of the driver knuckle 27 and the tube 11 as shown in FIG. 1 is approximately 128°.

As shown in the embodiment of FIG. 1, the head of golf club 1 is connected to lower tube 5 via one part 3*a* of universal joint 3. Another part 3*b* of universal joint 3 is rotatably connected inside bushing 4. Bushing 4 is fitted inside lower tube 5 and is bonded in place. Universal joint 3 allows golf club 1 universal movement relative to lower tube 5. Effectively, golf club 1 dangles freely from lower tube 5 and can rotate in any direction with head 1*b* of golf club 1 remaining at a fixed distance from driver knuckle 27 at all times.

The universal joint 3 for connecting the golf club 1 to lower tube 5 provides excellent "feel", flex and durability, uses an elongated piece of flexible plastic such as an elastomer 51, approximately 1½ inches long and made of polyurethane or the like, which connects the head of golf club 1 to lower tube 5. The top end of the flexible tubing 51 is solidly fixed by bonding or molding to a bushing 4 rotatably connected to one part 3*b* of the universal joint.

Part 3*b* includes a bushing shaft which is inserted into bushing 4 so that it rotates within the bushing 4. Bushing 4 is bonded inside lower tube 5 so that golf club head 1*a* is rotatably mounted on lower tube 5 and the flexible plastic tubing or rod 51 flexes fore and aft and side to side, providing three degrees of movement for golf club head 1*b*.

Figure 8:
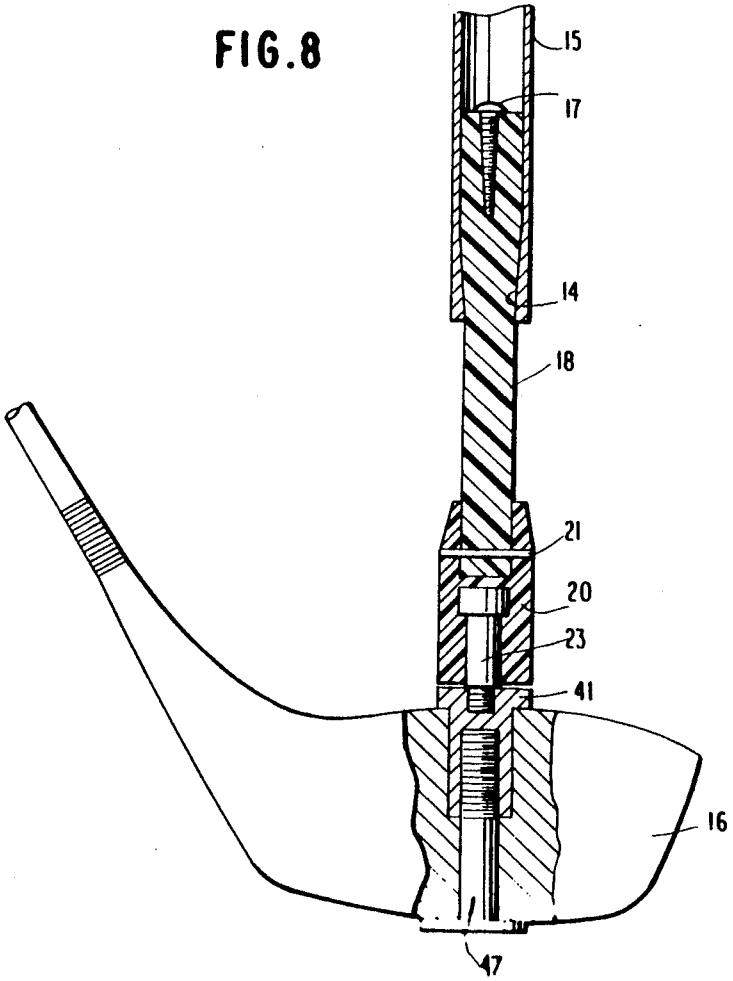
FIG. 8 is a detailed sectional view of a second embodiment of a universal connector for a golf club head.

A second embodiment of a universal connection between the golf club head and the lower tube is shown in FIG. 8. The lower end of the tube 15 is provided with a radially inwardly directed taper 14. A flexible, cylindrical shaft 18 of polyurethane elastomer is inserted into the lower end of the tube 15 and expanded by means of screw 17 to firmly secure the shaft 18 against longitudinal and rotational movement. A suitable adhesive may also be used to secure shaft 18 in the tube 15.

A plastic bushing 20 is secured to the lower end of the shaft 18 by means of a pin 21. The bushing 20 is provided with a stepped cylindrical recess and a shoulder bolt 23 having a configuration complementary to the recess is freely rotatable therein while being restrained from longitudinal movement.

A bushing 41 is secured in the club head 16 by a bolt 42. The bolt 23 is threaded into the bushing 41 for detachably connecting the club assembly to the universal connector assembly.

Figure 9:
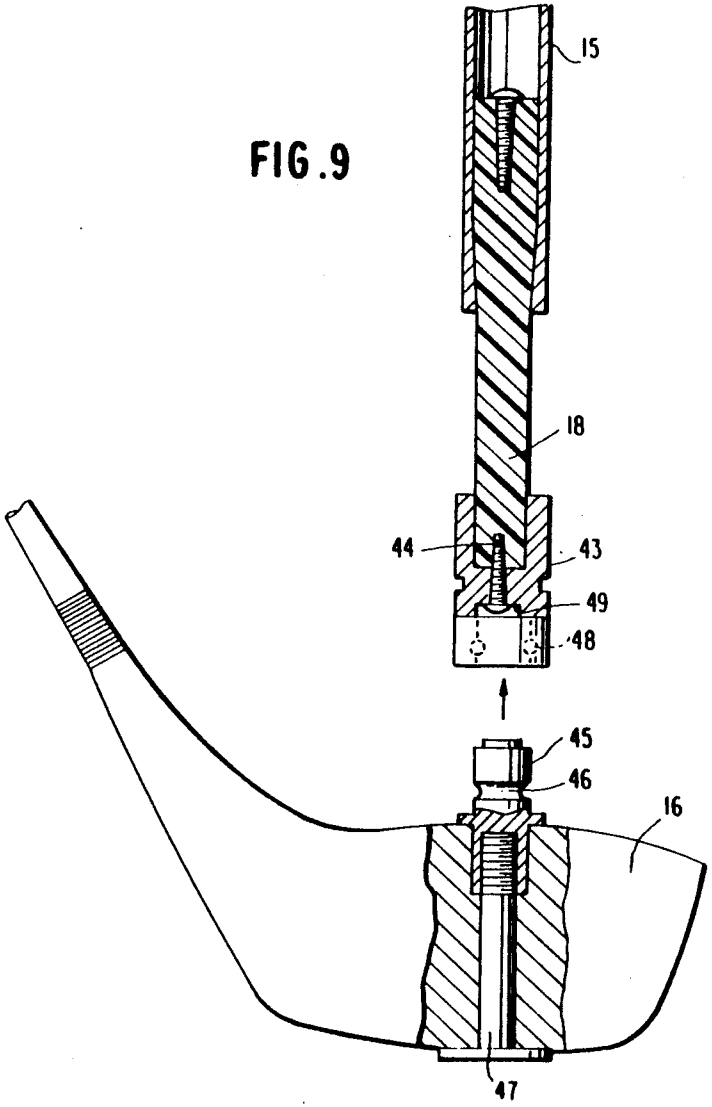
FIG. 9 is a detailed sectional view of a third embodiment of a universal connector for a golf club head.

A third embodiment of a universal connection is shown in FIG. 9. The flexible elastomer shaft 18 is secured in the lower end of tube 15 in the same manner as described above with respect to FIG. 8. A swivel socket connector 43 is connected to the lower end of shaft 18 by a screw 44. The socket connector 43 is provided with a cylindrical recess 49 in the lower end thereof having a ball bearing ring 48 resiliently mounted therein as shown in FIG. 9*a*. A coupler plug 45 having an annular groove 46 therein is detachably connected to the club head 16 by a bolt 47. The club assembly maybe quickly connected to the swivel socket 43 by pushing the coupler plug 45 upwardly into the recess to seal the ball bearing ring in the groove 46 for rotation relative thereto.

The foregoing embodiments of a universal connector shown in FIGS. 1, 8 and 9 are suitable for connecting the telescopic tube assembly to the head of a "wood" club. Since it is not practical to drill a hole through the head of a putter or iron, the universal connectors of FIGS. 8 and 9 have been modified for connection to the shaft of a putter or iron immediately adjacent the head thereof.

Figure 11:
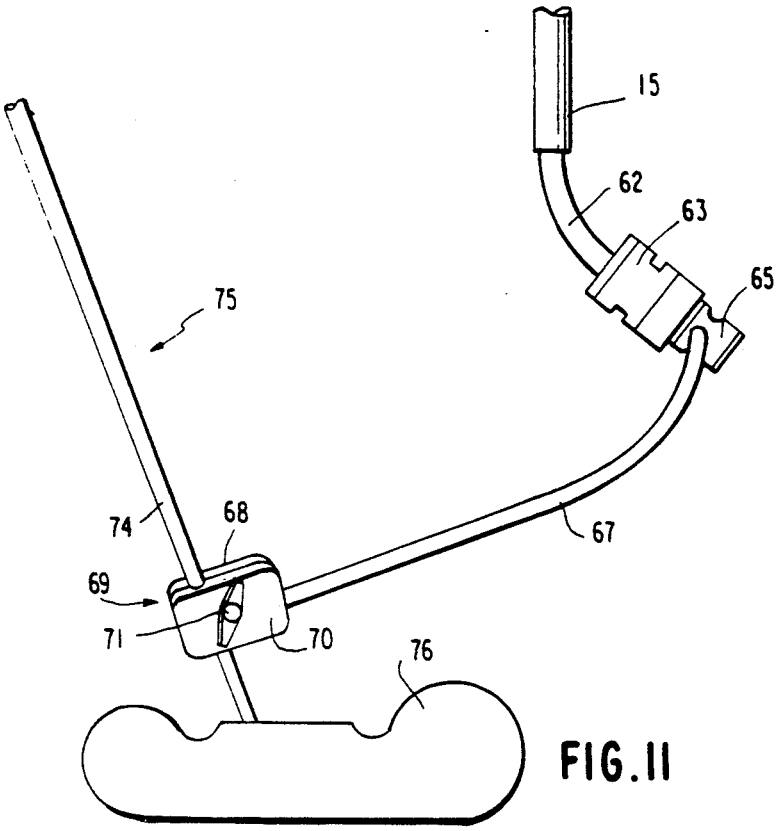
FIG. 11 is a perspective view of a first embodiment of a universal connector for a putter and irons.

In the embodiment of FIG. 11, the universal connector, which is similar to the connector shown in FIG. 9, is comprised of an elastomer shaft 62 which is secured in the lower end of tube 15. A swivel socket connector 63 is connected to the lower end of shaft 62 by a screw. The socket connector 63 is provided with a cylindrical recess in the lower end thereof with a ball bearing ring resiliently mounted therein identical to the socket connector 43. A coupler plug 65 having an annular groove 66 therein is connected to a curved, substantially rigid spring steel rod 67 by welding or the like. The opposite end of the rod 67 is connected to a first plate 68 of a two part clamp 69 by welding or the like. A second plate 70 is clamped to the plate 68 by means of a screw clamp 71 extending through a hole in the plate 70 and screwed into the plate 68. The two plates 68 and 70 have opposed grooves 72 and 73 for engaging the shaft 74 of a putter 75 adjacent the head 76. The plug 65 can readily be coupled to or uncoupled from the swivel socket connector 63 by a push-pull action and the clamp 69 can readily be coupled to or uncoupled from the putter by rotation of the screw champ 71 in opposite directions.

Figure 12:
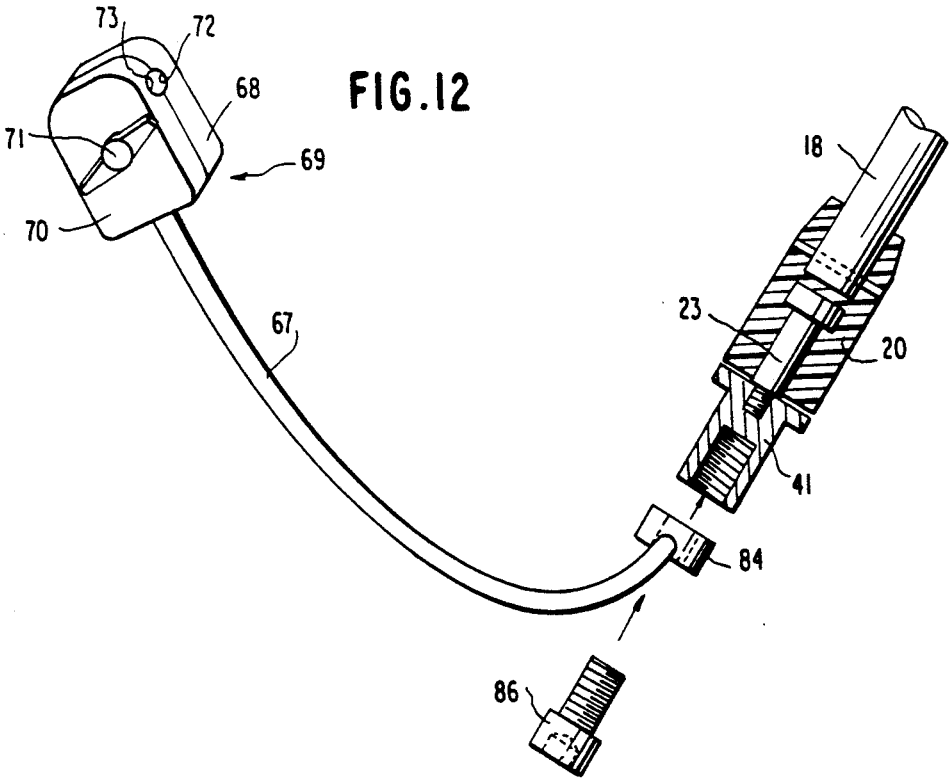
FIG. 12 is a perspective view of a second embodiment of a universal connector for a putter and irons.

In the embodiment of FIG. 12, the shaft 18, bushing 20, bolt 23 and bushing 41 are identical to the components shown in FIG. 8. The rod 67 and clamp 69 are identical to the rod and clamp shown in FIG. 11 but a cylindrical sleeve 84 is welded to the end of the rod 80 instead of the coupler plug. The sleeve 84 is clamped against the end of bushing 41 by means of a bolt 86 screwed into the bushing 41.

To connect upper tube 11 at one end to lower tube 5, a cam bushing is bonded inside lower tube 5. A circular cam lock interior of tube 11, is rotatably secured to the cam bushing, also interior of tube 11, by a cam retaining pin, which passes through an off-center hole in the cam lock and is fixed to an off-center hole in the cam bushing. Turning lower tube 5 relative to tube 11, either loosens or tightens the cam lock against the interior side wall of upper tube 11 thus allowing either adjustment of the tube assembly length or preventing telescopic movement of the telescopic tubes 5, 11. Tube end bushing 10 is bonded to the outer portion of upper tube 11 to assure a smooth fit between lower tube 5 and upper tube 11. The diameter of an opening therein is smaller than the diameter of upper tube 11 but slightly larger than the diameter of lower tube 5.

Figure 10:
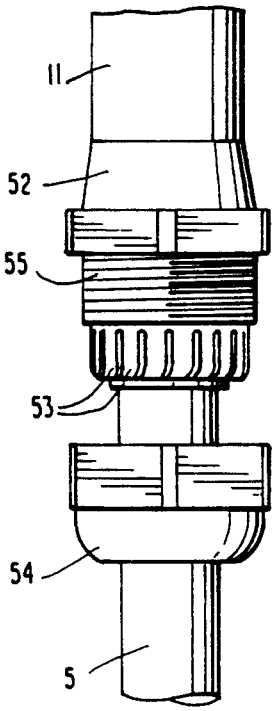
FIG. 10 is a detailed sectional view of a modified clamping device for securing the telescopic tubes in an adjusted position.

An alternative connection between the telescopic tubes 11 and 5 is shown in FIG. 10. A bushing 52 is bonded to the lower end of tube 11 and is provided with a plurality of clamping fingers 53 at the free end thereof disposed in sliding engagement with tube 5 as shown in FIG. 10*a*.

A cap 54 is fitted over the tube 5 and is in threaded engagement with threads 55 on the bushing 52. When the cap is rotated further onto the bushing 52, the interior of the cap will engage the fingers 53 to force them into clamping engagement with tube 5, thereby preventing telescopic movement of the tubes 5 and 11. When the cap is rotated in the opposite direction, the pressure on the fingers 53 will be relieved permitting movement of tube 5 into or out of tube 11.

Figures 2, 4:
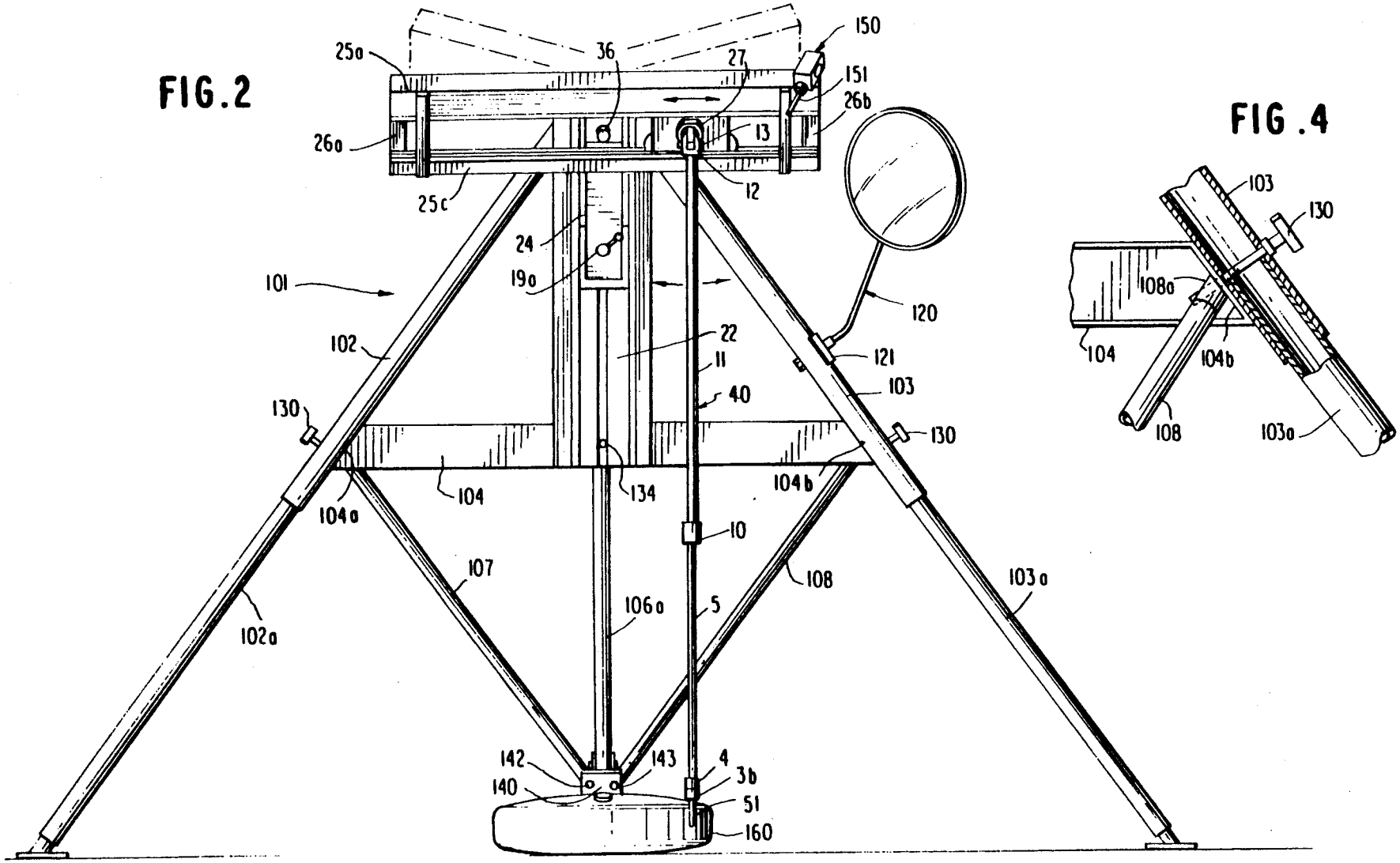
FIG. 2 is a front elevational view of the apparatus of FIG. 1.
FIG. 4 is an enlarged sectional view of the apparatus of FIG. 1, taken about line 4—4.

Upper tube 11 is connected to driver knuckle 27 (shown in FIG. 6) of gear head assembly 25 by a top tube yoke or clevis 12, FIG. 2, and yoke pin 13. Yoke 12 has aligned holes, receiving pin 13, and the gears in gear head assembly 25 combine to provide a universal connection between upper tube 11 and gear head assembly 25.

Figure 3:
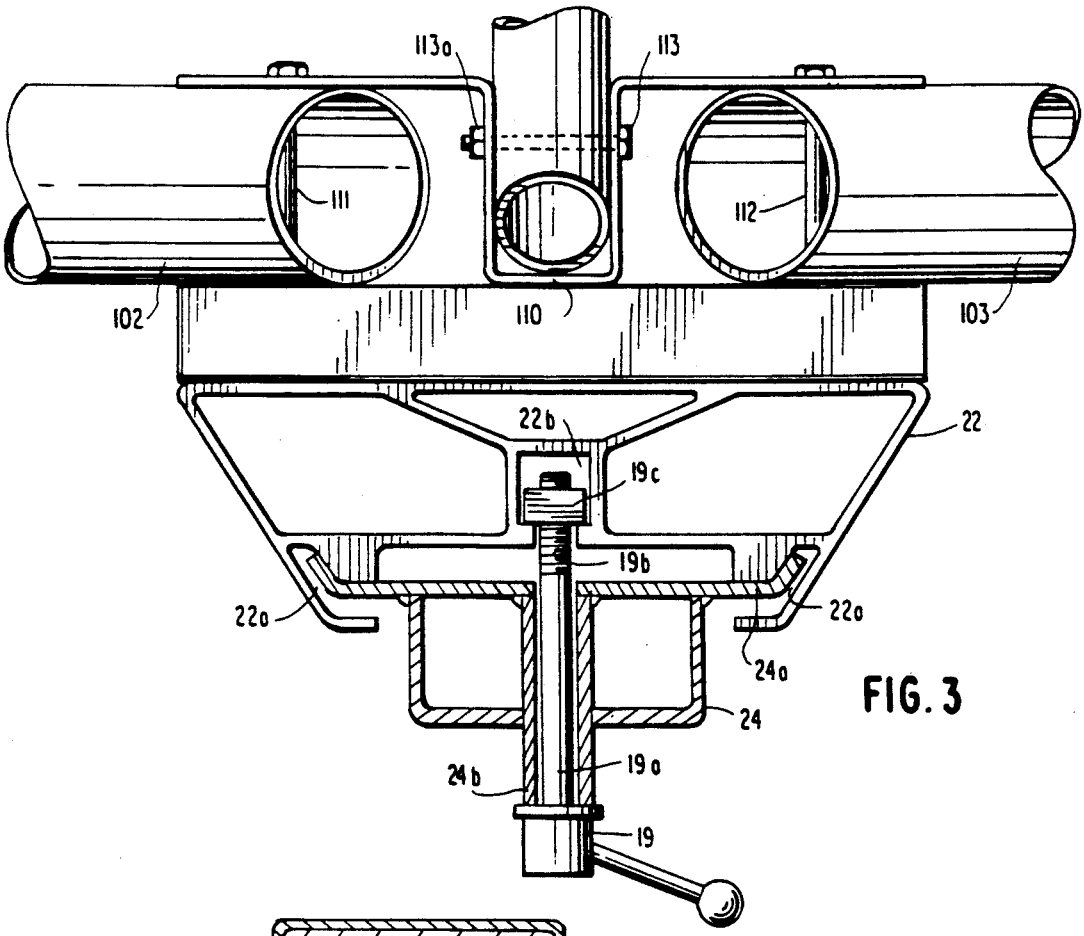
FIG. 3 is an enlarged sectional view of the apparatus of FIG. 1, taken about lines 3—3.

FIG. 3 shows the means for slidably mounting gear head assembly 25 onto main support tube 22. The gear head assembly is detachably connected to the vertically adjustable gear head assembly arm mount 24. The lower end of the arm mount 24 has a dovetail shaped portion 22*a* fixed thereto which conforms to the shape of slots 24*a* in main tube 22. The height of the gear head assembly is adjusted by sliding arm mount 24 up or down the main support tube 22. The arm mount 24 is locked in place at the desired position by a threaded bolt 19*a* passing through a tube 24*b* secured to arm mount portion 24*a*. The threaded end 19*b* of bolt 19*a* carries a nut 19*c* captured in a cavity 22*b* of the support tube 22 to clamp the dovetailed shaped portion 24*a* to tube 22 at slots 22*a*.

Figure 6:
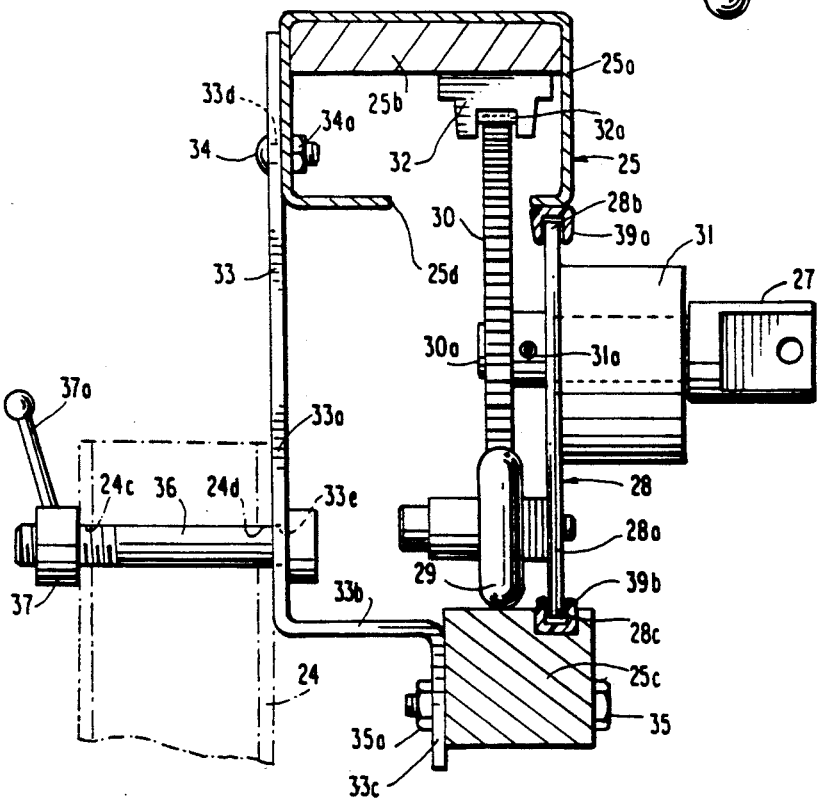
FIG. 6 is an enlarged sectional view of the gear head assembly of FIG. 5, taken about line 6—6.
Figure 5:
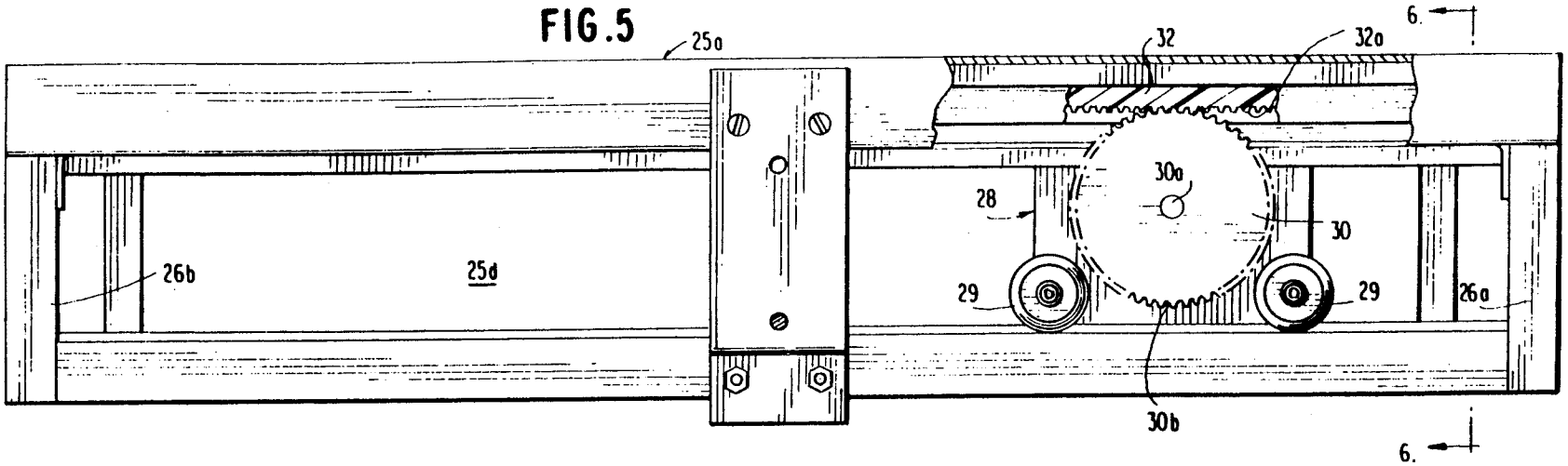
FIG. 5 is an enlarged sectional view of the gear head assembly taken about line 5—5 of FIG. 1.

The details of gear head assembly 25 are shown in FIGS. 2, 5 and 6. Assembly 25 consists of an upper frame housing 25*a*, in vertical section defining a horizontal longitudinal slot 25*d*, upper extrusion 25*b*, lower extrusion or beam 25*c*, a pair of end caps 26*a* and 26*b*, driver knuckle 27, tracking assembly mount or carriage 28, tracking gear 30, bushing 31, a gear track 32 and a pair of tracking wheels 29. Upper extrusion 25*b* is fixed to the top, inner portion of housing 25*a* by screws, bonding or the like and lower extrusion 25*c* is fixed to the housing 25*a* and extrusion 25*b* by the end caps 26*a* and 26*b* and bracket 33. Gear track 32 is fixed to upper extrusion 25*b* by screws (not shown), bonding or the like.

Driver knuckle 27, which extends out from the assembly 25 between housing 25*a* and extrusion 25*c* to connect to upper tube 11, is fixedly mounted to driver tracking gear 30 about shaft 30*a* via set screw 31*a*, FIG. 6. Thus, as the telescopic tube assembly 40 swings, driver knuckle 27 rotates about its axis and driver tracking gear 30 rotates about a common axis in the same direction as driver knuckle 27.

In the preferred embodiment, shown in FIGS. 5 and 6, driver tracking gear 30 of circular disc form, is meshingly engaged with gear track 32, which is a flat rack gear with multiple gear teeth 32*a*. The peripheral surface of gear 30 has gear teeth 30*b* in mesh with the gear teeth 32*a* of the track 32. Driver tracking gear 30 is maintained in meshing engagement with gear track 32 by tracking wheels 29, which are mounted for rotation on axles secured to tracking assembly mount 28. Tracking wheels 29 roll on the upper flat surface (or in a track portion) of the lower extrusion 25*c* of the gear head assembly 25 so that driver tracking gear 30 engages the gear track 32.

The upper and lower horizontal edges 28*b*, 28*c* of the tracking assembly mount 28 are fitted inside U-channels 39*a* and 39*b*, respectively. The U-channels 39*a* and 39*b* are fixed to the housing 25*a* and extrusion 25*c*, respectively, and extend along the entire length of housing 25*a* from end cap 26*a* to end cap 26*b*. The U-channels 39*a* and 39*b* act as upper and lower guides for the tracking assembly mount 28, and support for the carriage against lateral forces exerted on the tracking assembly during operation.

The benefit of the preferred embodiment utilizing the flat tracks and wheels is smooth action between the gears and track, and sound deadening qualities.

Alternatively, U-channels 39*a* and 39*b* may be eliminated by using concave upper and lower extrusions (not shown) and a concave gear track for supporting a convex tracking gear and convex wheels. A concave profile of the gear track and the extrusions, if provided, provides the necessary support to take up the lateral forces acting on the carriage. Such modified assembly mount or carriage could be shorter and the housing extended further down to the knuckle 27 than in the preferred embodiment since such assembly mount would not be guided by U-channels.

Figure 7:
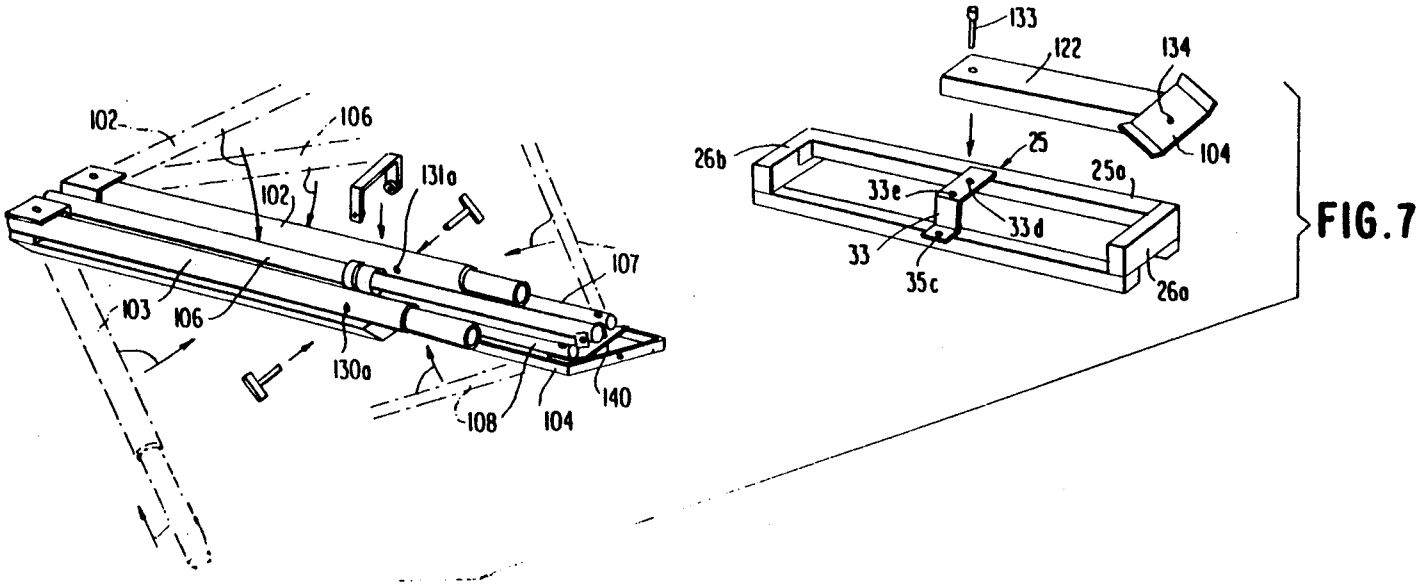
FIG. 7 is an enlarged perspective view of the gear head assembly and the tripod assembly, after disassembly of the apparatus of FIG. 1.

The gear head assembly 25 includes on the rear, as seen in FIGS. 6 and 7, a longitudinally centered bracket 33 which includes a flat section 33*a* joined to a flat offset portion 33*c* by a right angle integral connecting portion 33*b*. Section 33*a* is connected via screw 34 and nut 34*a* to the rear of the housing 25*a* and section 33*c* is bolted to beam 25*c* via bolt 35 and threaded nut 35*c*. Holes 33*d* and 33*e* are formed within the flat portion 33*a* of the bracket 33 which selectively receive the threaded shank of screw 34 and a threaded shank 36*a* of locking bolt 36, with locking bolt 36 having a nut 37 threadedly mounted thereto and bearing an outwardly projecting handle 37*a*. In turn, the upper end of the arm mount 24 includes a pair of aligned holes 24c and 24d, FIG. 6, through which the bolt shank 36 passes. By tightening down on nut 37 by rotation of handle 37a the gear head assembly 25 is fixedly mounted to the face of the tubular arm mount 24.

The gear head assembly 25 may be fixedly mounted to the face of tubular arm mount 24 at an angle to the horizontal. The gear head assembly is preferably tilted clockwise 10° relative to the horizontal for a right handed golfer and counter clockwise 10° relative to the horizontal for a left handed golfer.

In operation, the player swings golf club 1 causing telescopic tube assembly 40 to rotate, the components of gear head assembly 25 function in the manner described below. The motion of telescopic tube assembly 40 causes driver knuckle 27 to rotate, thus the driver tracking gear 30 also rotates. The meshed connection between driver tracking gear 30 and gear track 32 causes driver tracking gear 30, tracking wheels 29, carriage 28 and driver knuckle 27, as an assembly, to move horizontally along gear head assembly 25, as shown in FIG. 8. End caps 26a and 26b restrict the horizontal movement of carriage 28 to within the confines of gear head assembly 25. The end result is to cause the golf club to swing through an elliptical path rather than a circle, as occurs in the prior art.

The main support tube or upright vertical member 22 which extends vertically is fixedly connected to a tripod indicated generally at 100. This allows the gear head assembly 25 to be set at a maximum necessary height by shifting arm mount 24 up and down and locking the arm mount to the main tube support 22. The main support tube 22 carries on opposite sides, integral dovetail-shaped slots 22a to allow connection with gear head assembly mount arm 24.

A rubber tee (not shown) may hold a golf ball so that the player may hit the ball while practicing his swing. A mounting arrangement at one end allows a tee bar (not shown) to swing in a 180° arc with the tee (not shown) fitted in one of the multiple holes in the tee bar. By 180° rotation of the tee bar and by use of multiple holes therein, a variable tee positioning may be effected within the arc along the length of tee bar.

This allows for players of different height to obtain the proper back swing by allowing each player to vary the distance he stands from gear head assembly 25. Also, the player may easily change the position of the tee to practice his swing with the tee at different positions relative to his stance.

The main support tube 22 is useful to fix the apparatus to a variety of different surfaces and fixtures. Dovetail wall mount brackets (not shown), formed of a sheet metal plate may be used to fix the apparatus to a wall in a house or the side of a utility shed. Tubular brackets may be used to attach the tube 22 to a vertical pole.

Preferably, the apparatus is mounted so that it is free standing on the ground. FIGS. 1, 2, 3 and 7 show the tripod assembly 100 for an on-ground mount. This provides a stumble free, non-protruding set up.

The main support tube 22 is fixedly mounted to an A-frame 101. A-frame 101 consists of telescopic tubular side legs 102 and 103, front support channel 104, and leg pivot bracket 110. A-frame 101 is normally supported in a vertically upright position, perpendicular to the ground, by telescopic rear leg 106, and support struts 107 and 108. Legs 102, 103 and 106 are pivotally connected at the top of A-frame 101 by leg pivot bracket 110. Legs 102 and 103 are pivotally connected to leg pivot bracket 110 by pins 111 and 112, respectively, FIG. 3, which allow legs 102 and 103 to pivot in the same plane. Rear leg 106 is pivotally connected by a bolt 113 and nut 113a extending transversely through aligned holes in walls of a leg pivot bracket 110 which allows rear leg 106 to pivot in a plane perpendicular to the parallel pivot planes of legs 102 and 103.

Front support channel 104, is removably fixed between legs 102 and 103, and extends parallel to the ground. Knurled screws 130 pass through legs 102, 103 and have threaded ends 130a which then pass through respective end walls 104a and 104b of front support channel 104 and then into respective threaded ferrules 107a, 108a, in support struts 107, 108 respectively, to detachably fix legs 102, 103, struts 107, 108 and channel 104 together.

In order to counterbalance the forces applied to tripod 100 by the swinging of golf club 1, rear leg 106 and support struts 107 and 108 are pivotally fixed to counterweight 160 by base bracket 140. Rear leg 106 is pivotally connected to bracket 140 by pin 141. Support strut 108 is pivotally fixed to bracket 140 by bolt 143. Likewise, support strut 107 is pivotally fixed to bracket 140 by bolt 142. Bracket 140 is then removably fixed to counter-weight 160 to facilitate knockdown of the apparatus for folding and storage or transport to other locations. Counterweight 160 is a hollow body formed of molded plastic with a removable plug 160a so that it may be filled with water, sand or the like.

Main support tube 22 is fixed to A-frame 101 at leg pivot bracket 110 and front support channel 104. The side of main support tube 22 near the top of the tube is fixed by a bolt or the like (not shown) to leg pivot bracket 110. The other end of the main support tube 22 is connected to the A-frame 101 at front support channel 104 by a bolt 134 having knurled knob 132.

The pivotal connections, removable connections and telescopic legs 102, 103 and 106 allow for compact storage of tripod 100. Leg 102 telescopingly carries a smaller diameter leg 102a. Leg 103 telescopingly carries a smaller diameter leg 103a. To store tripod 100, the base bracket 140 is removed from counterweight 160. Knurled screws 130 and 131 are unscrewed to remove support struts 107 and 108 from legs 102 and 103, respectively, and front support channel 104 Then, knurled screw 132 is removed to detach the front support channel 104 from the main support tube 22. This completes the removal of all of the detachable parts.

Next, telescopic legs 102, 103 and 106 are collapsed by sliding the lower tubes 102a, 103a and 106a up into the upper tubes, respectively. Lower tubes 102a, 103a and 106a are fixed in their collapsed position by inserting knurled screws 130 and 131 into holes 130a and 131a, (FIG. 7) respectively, formed in respective upper tubes 103, 102. Then collapsed legs 102, 103 and 106 are pivoted in towards main support tube 22 so that all three legs are parallel to main support tube 22 as shown in FIG. 7. Also, bracket 140 is pivoted about rear leg 106, and support struts 107 and 108 are pivoted towards rear leg 106, until support struts 107 and 108 are parallel to rear leg 106 (FIG. 7).

Tripod 100 provides two important advantages. First, the removable and pivotal connections allow for quick assembly and disassembly so that the entire machine can be folded up and easily stored. Second, tripod 100 provides a more natural practice environment since there are no poles or supports near the golf ball being struck.

Main support tube 22 may, when detached from tripod 100, also be mounted on a wall. Main support tube 22 is also mountable by fastening screws onto a wall through pre-punched holes in main support tube 22. The pre-punched holes are also useful for mounting main support tube 22 to other surfaces such as fence posts, trees, brick, wood siding, and the like. Alternatively, main support tube 22 is attachable to a pole base by U-bolts.

In the preferred embodiment, a hitting mat (not shown) may be substituted for tee bar (not shown) to place rubber tee at the desired position in the player's stance. A tee may be fixed to the mat by inserting the tee through a hole in the mat. Such a hitting mat is similar to those commonly used at driving ranges.

An optional feature of the apparatus is a mirror 120 (FIG. 2) attachable to either the main support tube 22 or a leg 102, 103 of tripod 100. A clamping bracket 121 attaches the mirror and allows the mirror to tilt as necessary for the player to watch his stroke. The mirror is mountable on either side of main support tube 22 or to tripod leg 103 as per FIG. 2 or leg 102 (to accommodate for both right and left handed players).

Another optional feature is electronic swing sensor 150, shown in FIGS. 1–2 to help a player practice the proper inside out forward swing. Sensor 150 may comprise a buzzer, a battery and a switch to emit an audible tone when the player's swing is improper. A flexible switch arm 151 connected to an internal switch may be brushed by upper tube 11 on the back swing without effect. Sensor 150 sounds only on the forward swing, because switch arm 151 causes the switch to be one-way activated. If the forward swing is a proper inside out forward swing, upper tube 11 will be farther from switch arm 151 on the forward swing than on the back swing. Therefore, suspension rod upper tube 11 will not contact switch 151 on the forward swing and sensor 150 will not sound. However, if upper tube 11 strikes switch 151 during the forward swing, sensor 150 produces a tone, thus indicating an improper forward swing. FIGS. 1 and 2 show the position of upper tube 11 relative to switch 151 for a proper back swing and forward swing, respectively for a right handed player. The switch 151 may be mounted at the opposite end of the gear head assembly 25 for a left handed golfer.

The operation of the apparatus as a whole for a right-handed player is described below. First the apparatus is adjusted to accommodate for the height of the player. Gear head arm mount 24 is slid up or down the main support tube 22 and fastened at a desired vertical height by threaded lock bolt 19*a*. Also, the length of telescopic tube assembly 40 is increased or reduced by twisting lower tube 5 relative to upper tube 11 to disengage the cam lock; sliding lower tube 5 up or down with upper tube 11, and twisting lower tube 5 relative to upper tube 11 to engage the internal cam lock. The adjustments to gear head arm mount 24 on main support tube 22 and telescopic tube assembly 40 are combined to accommodate for the height of the player. The gear head assembly is then titled 10° clockwise.

Next, a tee (not shown) is set at the desired location relative to the player's stance. The desired location is set by a swinging tee bar (not shown) to the proper angle within its 180° arc and placing a tee (not shown) in the proper hole in the tee bar. Alternatively, a hitting mat is moved as necessary until a tee is properly positioned.

The adjustments to the height of gear head assembly 25, the length of telescopic tube assembly 40, and the position of the tee (if a ball is being used) allow all players, regardless of height and build, to practice, automatically, a swing with the proper elliptical club back swing and varied follow through with only minor adjustments to the apparatus, all of which may be made quickly and efficiently in a matter of minutes.

The three adjustments are varied until the player when swinging golf club 1 has a flat back swing. That is, at the peak of the back swing golf club 1 is parallel to the ground and the head is pointing in a direction parallel to the desired flight path of the ball once struck. In general, the distance of the player from gear head assembly 25 governs the flatness of the back swing.

Next, the apparatus is adjusted to accommodate the desired type of follow through, either high or low over the person's shoulder or somewhere in between. This is best accomplished by adjusting the height of gear head assembly 25. The higher gear head assembly 25 is set, the lower the back swing and vice versa.

An additional benefit of the adjustable features is apparent during indoor use. The adjustable features allow the player to keep the swing within the constraints of the walls and ceiling of the room.

The apparatus is now ready for use by the player. The player's motion is composed of two movements: first, the back swing and second, the forward swing.

The back swing causes the locked telescopic tube assembly or rigid rod 40 to rotate counterclockwise (relative to a right-handed player facing the apparatus) with driver knuckle 27 functioning as the center of rotation. The counterclockwise swing of telescopic tube assembly 40 causes driver knuckle 27 to rotate counterclockwise. As a result, driver knuckle 27 rotates with tracking gear 30 about its axis and drives the carriage 28 on tracking wheels 29 longitudinally horizontally to the right towards end cap 26*b*.

The combination of the movements described above result in two distinct motions acting on golf club 1. First, a rotational movement where driver knuckle 27 acts as the center of rotation. Second, a horizontal linear movement of the carriage 20 along gear track 32 of the gear head assembly 25.

The rotational movement is a result of the swinging motion of telescopic tube assembly 40 about driver knuckle 27. The horizontal linear movement is a result of the rotation of driver knuckle 27 and tracking gear 30 which moves driver knuckle 27 via carriage 28 along gear track 32 and the result is to superimpose on the club 1, an elliptical motion during the swing.

The rotational movement is not limited to a single plane. Although the player should not vary the swing plane (i.e., plane of the rotational movement) during the back swing or during the forward swing, the swing plane should differ between the back and forward swings. The ideal back swing is "squared off", i.e., in the plane parallel to the intended direction of the ball, once struck. The ideal forward swing is "inside out", i.e., in a plane intersecting the plane of the back swing, and one where club head 1*a*, FIG. 1, starts close to the player and moves away from the player as the club is swung forward and into the follow through, after contact with the ball.

Yoke 12 and yoke pin 13 rotatably connecting upper tube 11 to driver knuckle 27 facilitates changing the orientation of the swing plane. Yoke 12 allows upper tube 11 to rotate in the plane perpendicular to the face of gear head assembly 25.

The horizontal linear movement and rotational movement continues until the player reaches the peak of his back swing. The player then swings golf club 1 forward to strike the ball on tee 20. The forward swing causes the telescopic tube assembly 40 and driver knuckle 27 to rotate clockwise and causes driver knuckle 27, along with tracking gear 30 and tracking wheels 29 on carriage 28, to move longitudinally to the left towards end cap 26*a*. Just as with the back swing, the forward swing of golf club 1 contains the same two components: rotational movement and horizontal linear movement. The key difference between the back and forward swings is the variation in the swing plane previously described.

The forward swing is continued through the position of tee 20 until the player completes the follow through.

The apparatus controls the player's swing continuously from the start of the back swing to the follow through of the forward swing and allows for variation in the swing plane between the back and forward swings. As a result, the player learns the proper form, motion and rhythm of a complete golf swing. The dual motion of the golf club 1 caused by the apparatus properly controls the swing of the player without improperly restricting the movement of the player's body. Thus, the apparatus emulates a proper swing under real playing conditions for any type of golf swing (drive, pitch, put, and the like using various clubs 1 such as a driver, a wedge, a putter, etc.). The three axes, movable flexible plastic tube, connection between the lower end of the suspension rod 40 permit the club face to pivot away from or towards the player holding the club for controlled slice or hook of the ball when struck.

While the invention has been particularly shown and described with reference to preferred embodiments thereof, it will be understood by those in the art that the foregoing and other changes in form and details may be made therein without departing from the spirit and scope of the invention.

What is claimed is:

1. An apparatus for developing a player's golf swing by guiding the swing of a golf club to emulate the swing of an expert player, said apparatus comprising:

a vertical support, a first guide means mounted on said vertical support above the shoulder height of said player, a second guide means comprising a generally rigid club suspension rod supported solely from said first guide means at an upper end thereof and being of a length such that an opposite, lower end thereof is at substantially the same level at which a head of said golf club engages a teed golf ball, a universal connection means carried by the lower end of said suspension rod for connecting said suspension rod lower end to said golf club having said head thereon, and coupling means for rotatably coupling said upper end of said suspension rod to a drive member for rotation of said drive member about an axis disposed at an angle to the axis of said suspension rod and means carried by said first guide means and responsive to rotation of the drive member about said axis by said golf club for shifting the coupling means substantially horizontally in fore and aft directions parallel to the flight path of the ball upon impact therewith by the golf club head during swinging of the golf club by the player depending upon the direction of rotation of said coupling means by said suspension rod about said axis such that the golf club is subjected to an elliptical motion during the backward and forward swings, thereby permitting the player to effect a full shoulder turn allowing the club to attain a position parallel to the flight path at the conclusion of the back swing and a transition of the swing plane allowing a proper "inside-out" down swing and follow through of the golf club.

2. An apparatus as claimed in claim 1, wherein said first guide means comprises a gear head assembly including a substantially horizontal elongated track aligned generally in the direction of a desired flight path of a golf ball when struck by the club head, a carriage mounted on said track for substantially horizontal movement longitudinally along said track, said drive member comprising a driver knuckle rotatably mounted on said carriage for rotation about an axis at right angles to the longitudinal direction of movement of said carriage on said track, said coupling means coupling said upper end of said rod to said drive knuckle for rotation about the axis of said knuckle, and gear train means coupling said rotatable driver knuckle to said carriage for translating rotation of said driver knuckle about said axis into horizontal carriage movement longitudinally along said track such that said driver knuckle is shifted fore and aft in a substantially horizontal direction proportional to the degree of rotation of said driver knuckle about the pivot axis thereof in either direction thereby permitting the golf club shaft to move into positions at the top of both the backward and forward swings parallel to the flight path.

3. An apparatus as claimed in claim 2 wherein, said gear train comprises a circular tracking gear fixed to the driver knuckle for rotation therewith about said axis and having gear teeth on the periphery thereof, and a linear rack gear fixedly mounted to said gear head assembly and in mesh with said circular tracking gear such that rotation of said circular tracking gear causes said carriage to move longitudinally along said track means driven by rotation of the tracking gear.

4. An apparatus as recited in claim 3, wherein, said gear head assembly comprises an elongated housing, upper and lower tracks formed internally of said housing facing each other, said upper track is constituted by said gear rack and faces the lower track, aligned with said circular tracking gear and having rack teeth in mesh with the peripheral teeth of the tracking gear, said carriage includes a pair of wheels mounted along a lower edge thereof for rotation about axes at fore and aft ends of said carriage, said wheels being in peripheral engagement with the lower track of said casing, such that said wheels maintain the tracking gear teeth in mesh with the teeth gear rack of said upper track and wherein said rotatable knuckle projects outwardly of the face of said housing remote from said vertically upright support assembly and movable horizontally along a slot within said housing.

5. An apparatus as recited in claim 4, wherein, said vertical support comprises a tripod fixed to said vertically upright support member.

6. An apparatus as recited in claim 5, wherein said tripod comprises a plurality of tubular members pivotally mounted at one end thereof to one end of a leg pivot bracket, in side by side fashion, wherein said legs comprise a telescopic rear leg and telescopic side legs to opposite sides thereof whereby, for transport, said telescopic tubular side legs and said telescopic rear leg may be pivoted into generally parallel side by side positions and wherein said telescopic rear leg and said telescopic side legs may be slidably retracted therein to affect collapsing of the telescopic tubular legs into positions aligned with and overlying a face of the leg pivot bracket.

7. An apparatus as set forth in claim 6, further comprising weight means secured to said rear leg adjacent the lower end thereof and stabilizer rods connected between said weight means and mid points of said side legs.

8. An apparatus as recited in claim 2, wherein, said upper end of said suspension rod terminates in a clevis pin connected to said knuckle.

9. An apparatus as claimed in claim 1, wherein said rod is a telescopic tube assembly comprising an upper tube and a lower tube.

10. An apparatus as recited in claim 9, wherein said upper tube is made of aluminum and said lower tube is made of a graphite composite.

11. An apparatus as recited in claim 9, wherein, said telescoping tube assembly includes means for adjustably locking the upper tube relative to the lower tube to maintain a given length of the suspension rod keyed to the height and position of the player and the golf club swung by the player.

12. An apparatus as recited in claim 1, wherein said vertical support comprises a vertical upright support member having a vertical axis, said first guide means comprises a gear head assembly, a gear head assembly support arm mounted on said vertical upright support member and extending obliquely upwardly and outwardly of said vertical support member toward the player and having fixedly mounted thereto remote from said vertical upright support member, said gear head assembly thereby preventing interference in the swing of the golf club by the vertical upright support member during the player's swing.

13. An apparatus as recited in claim 12, wherein, the lower end of said gear head assembly support arm is slidably mounted to the vertically upright support member for raising and lowering the gear head assembly.

14. An apparatus as recited in claim 12, wherein, the gear head assembly is fixedly mounted to a face of the gear head assembly support arm and the axis of rotation of said drive knuckle is at an obtuse angle relative to the suspension rod when said rod is disposed parallel to the vertical axis of the vertical support member, whereby, the upper end of the golf club head suspension rod is prevented from binding at the driver knuckle when the rod is swung by movement of the golf club throughout said elliptical golf club swing.

15. An apparatus as recited in claim 14, wherein, the angle between the vertical axis of the vertical support member and the axis of rotation of said drive knuckle is in the range of approximately 22°-38°.

16. An apparatus as recited in claim 1, wherein said three axes connection means comprises a elongated flexible elastomer member and having one end thereof rotatably connected to one of said lower end of said suspension rod and top of said golf club head.

17. An apparatus as recited in claim 1, further comprising an inside out swing sensor fixedly mounted to said apparatus in the path of movement of said generally rigid rod for sensing rotation of the upper end of said generally rigid rod about said coupling means such that proper orientation of the golf club during the forward swing prevents contact between the inside out swing sensor and the second guide means in the generally rigid rod while improper orientation of the golf club during the forward swing causes the physical contact between the rotating rigid rod and the inside out swing sensor.

18. An apparatus as recited in claim 17, wherein said inside out swing sensor comprises an audible sound producing means, a battery for energizing said audible sound producing means, a circuit including a one way switch connecting said battery to said audible sound producing means, and a flexible switch arm operatively coupled to said switch and mounted to said first guide means and extending outwardly therefrom in the direction toward said player such that the end of said flexible switch arm if brushed by said rigid rod on the forward swing of the player if an improper inside out forward swing will close the switch.

19. An apparatus as recited in claim 18, wherein said inside out swing sensor comprises a compact unit effectively mounted to a gear head assembly constituting said first guide means.

20. An apparatus as set forth in claim 1, wherein said first guide means is adjustably mounted in a substantially horizontal position on said vertical support for slight tilting movement in opposite directions for left handed and right handed golfers respectively.

21. An apparatus as set forth in claim 1, wherein said universal connection means is comprises of a flexible elongated shaft of elastomeric material fixedly connected at an upper end thereof to said suspension rod lower end, bushing means connected to an opposite end of said flexible shaft and coupling means adapted to be rigidly connected to a head of a golf club and rotatably connected to said bushing means.

22. An apparatus as set forth in claim 1, wherein said universal connection means is comprised of a flexible elongated shaft of elastomeric material fixedly connected at an upper end thereof to said suspension rod lower end, bushing means connected to an opposite end of said flexible shaft and coupling means adapted to be connected to a shaft of a golf club adjacent a head thereof and rotatably connected to said bushing means.

23. An apparatus as set forth in claim 22, wherein said coupling means is comprised of clamping means adapted to detachably engage a shaft of a golf club adjacent a head thereof, an elongated curved rigid rod and a connector rotatably connected to said bushing.

24. An apparatus as set forth in claim 1, wherein said coupling means is comprised of clamping means adapted to detachably engage a shaft of a golf club adjacent a head thereof, an elongated curved rigid rod and a connector rotatably connected to said bushing.

* * * * *